US012389959B2

(12) United States Patent
Blakely et al.

(10) Patent No.: US 12,389,959 B2
(45) **Date of Patent: *Aug. 19, 2025**

(54) ARTICLE OF APPAREL

(71) Applicant: Under Armour, Inc., Baltimore, MD (US)

(72) Inventors: Kyle Blakely, Baltimore, MD (US); Matthew Trexler, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/340,948

(22) Filed: Jun. 26, 2023

(65) Prior Publication Data

US 2023/0329366 A1 Oct. 19, 2023

Related U.S. Application Data

(60) Continuation of application No. 17/356,824, filed on Jun. 24, 2021, now Pat. No. 11,712,071, which is a (Continued)

(51) Int. Cl.
*A41D 13/00* (2006.01)
*A41D 13/002* (2006.01)
(Continued)

(52) U.S. Cl.
CPC ..... *A41D 13/0056* (2013.01); *A41D 13/002* (2013.01); *A41D 31/12* (2019.02);
(Continued)

(58) Field of Classification Search
CPC ..... A41D 13/005; A41H 43/00
See application file for complete search history.

(56) References Cited

U.S. PATENT DOCUMENTS 3,096,557 A * 7/1963 Messinger ..... D06C 29/00 28/167
4,208,485 A 6/1980 Nahta
(Continued)

FOREIGN PATENT DOCUMENTS

BY 011995 6/2009
JP 2008184693 8/2008
(Continued)

OTHER PUBLICATIONS

Supplementary EP Search Report for PCT/US14/59315, dated May 17, 2017.
(Continued)

*Primary Examiner* — Cachet I Proctor
(74) *Attorney, Agent, or Firm* — Edell, Shapiro & Finnan, LLC

(57) ABSTRACT

An article of apparel is formed that is effective to regulate the temperature of the wearer. In an embodiment, a thermal regulation composition is obtained comprising a binder, a cooling agent, a latent heat agent, and a heat dissipation agent. The thermal regulation composition is printed to a surface of a textile by pressing the thermal regulation composition against the textile surface such that the binder adheres the cooling agent, latent heat agent, and the heat dissipation agent to the surface of the textile, thereby forming a thermal regulation membrane, and the textile is incorporated into an article of apparel.

15 Claims, 8 Drawing Sheets

Related U.S. Application Data continuation of application No. 16/038,241, filed on Jul. 18, 2018, now Pat. No. 11,051,564, which is a division of application No. 14/507,270, filed on Oct. 6, 2014, now abandoned.

(60) Provisional application No. 61/886,835, filed on Oct. 4, 2013.

(51) Int. Cl.

| | |
|---|---|
| ***A41D 13/005*** | (2006.01) |
| ***A41D 31/12*** | (2019.01) |
| ***A41D 31/14*** | (2019.01) |
| ***A41H 43/00*** | (2006.01) |
| *A41D 1/00* | (2018.01) |
| *A41D 1/22* | (2018.01) |
| *A41D 31/30* | (2019.01) |

(52) U.S. Cl.

CPC ..... *A41D 31/125* (2019.02); *A41D 31/145* (2019.02); *A41H 43/00* (2013.01); *A41D 1/00* (2013.01); *A41D 1/22* (2013.01); *A41D 31/305* (2019.02); *A41D 2400/10* (2013.01); *A41D 2400/26* (2013.01)

(56) References Cited

U.S. PATENT DOCUMENTS

| | | | | |
|---|---|---|---|---|
| 4,438,167 | A | 3/1984 | Schwarz | |
| 4,753,840 | A * | 6/1988 | Van Gompel | B32B 27/308 428/218 |
| RE32,713 | E * | 7/1988 | Woo | B01J 13/025 428/323 |
| 5,415,222 | A | 5/1995 | Colvin et al. | |
| 5,636,380 | A | 6/1997 | Schindler et al. | |
| 5,722,482 | A | 3/1998 | Buckley | |
| 5,792,714 | A | 8/1998 | Schindler et al. | |
| 6,319,599 | B1 | 11/2001 | Buckley | |
| 6,503,976 | B2 * | 1/2003 | Zuckerman | D04H 11/00 524/475 |
| 6,660,667 | B2 * | 12/2003 | Zuckerman | D04H 11/00 442/131 |
| 6,855,410 | B2 | 2/2005 | Buckley | |
| 7,135,424 | B2 | 11/2006 | Worley et al. | |
| 7,544,416 | B2 | 6/2009 | Bellemere | |
| 7,837,723 | B2 | 11/2010 | Montain et al. | |
| 8,048,371 | B1 | 11/2011 | Kapur et al. | |
| 8,479,322 | B2 * | 7/2013 | Blackford | A47G 9/086 2/457 |
| 8,499,367 | B2 | 8/2013 | Almqvist | |
| 8,555,414 | B2 | 10/2013 | Davis et al. | |
| 8,726,414 | B2 | 5/2014 | Baron et al. | |
| 2002/0022606 | A1 * | 2/2002 | Kochevar | A61L 24/001 604/20 |
| 2002/0132091 | A1 | 9/2002 | Worley | |
| 2004/0033743 | A1 * | 2/2004 | Worley | D06M 23/16 442/131 |
| 2005/0223465 | A1 | 10/2005 | Williams et al. | |
| 2006/0276089 | A1 | 12/2006 | Amarasinghe et al. | |
| 2007/0124870 | A1 | 6/2007 | Turner | |
| 2008/0085290 | A1 | 4/2008 | Flugge-Berendes et al. | |
| 2008/0233368 | A1 * | 9/2008 | Hartmann | D06M 23/12 428/206 |
| 2009/0042468 | A1 | 2/2009 | Suzuki et al. | |
| 2009/0181254 | A1 | 7/2009 | White et al. | |
| 2009/0306748 | A1 * | 12/2009 | Mollendorf | A61F 7/00 607/104 |
| 2009/0320177 | A1 | 12/2009 | Lin et al. | |
| 2010/0015430 | A1 * | 1/2010 | Hartmann | B32B 27/08 428/323 |
| 2010/0077040 | A1 | 3/2010 | Hariharan et al. | |
| 2010/0280331 | A1 | 11/2010 | Kaufman et al. | |
| 2010/0282433 | A1 | 11/2010 | Blackford | |
| 2011/0028070 | A1 | 2/2011 | Pfitzenmayer | |
| 2011/0041230 | A1 | 2/2011 | Huang et al. | |
| 2011/0203783 | A1 | 8/2011 | Blackford et al. | |
| 2011/0296580 | A1 | 12/2011 | Dermarest et al. | |
| 2012/0055187 | A1 | 3/2012 | Raines et al. | |
| 2012/0077040 | A1 * | 3/2012 | Park | C09D 7/61 428/416 |
| 2013/0000022 | A1 | 1/2013 | Sokolowski et al. | |
| 2013/0042390 | A1 | 2/2013 | Blackford | |
| 2013/0047313 | A1 * | 2/2013 | Windisch | D04B 1/28 2/69 |
| 2013/0081193 | A1 | 4/2013 | Wallace, Sr. | |
| 2013/0103125 | A1 | 4/2013 | Radspieler et al. | |
| 2013/0115841 | A1 | 5/2013 | Ronner et al. | |
| 2013/0133353 | A1 * | 5/2013 | Araujo | F25D 31/00 62/331 |
| 2013/0212769 | A1 | 8/2013 | Lubets | |
| 2014/0000004 | A1 | 1/2014 | Baron et al. | |
| 2014/0007314 | A1 | 1/2014 | Davis et al. | |
| 2014/0013482 | A1 | 1/2014 | DiBernardo et al. | |
| 2014/0245527 | A1 | 9/2014 | Douglas et al. | |
| 2014/0326734 | A1 * | 11/2014 | Le Bris | B41M 5/0047 220/573.1 |

FOREIGN PATENT DOCUMENTS

| | | | |
|---|---|---|---|
| RU | 2277561 | | 6/2006 |
| WO | 1991009544 | | 7/1991 |
| WO | 1994012328 | | 6/1994 |
| WO | 2001001803 | | 1/2001 |
| WO | 02059414 | A9 | 2/2004 |
| WO | 2008116020 | A3 | 1/2010 |
| WO | 2010129923 | | 11/2010 |
| WO | 2014071528 | | 5/2014 |

OTHER PUBLICATIONS

The International Search Report, PCT/2014/059315, dated May 7, 2015.

McFarlin et al., "A shirt containing multistage phase change material and active cooling components was associated with increased exercise capacity in a hot, humid environment", Ergonomics Aug. 2016; 59(8): pp. 1019-1025.

* cited by examiner

ARTICLE OF APPAREL

CROSS REFERENCE TO RELATED APPLICATIONS

The present application is a continuation of U.S. patent application Ser. No. 17/356,824, filed Jun. 24, 2021, which is a continuation of U.S. patent application Ser. No. 16/038,241, filed Jul. 18, 2018, which is a divisional of U.S. patent application Ser. No. 14/507,270, filed Oct. 6, 2014, which claims priority to U.S. Provisional Patent Application Ser. No. 61/886,835, filed Oct. 4, 2013, the disclosures of which are hereby incorporated by reference in their entireties.

FIELD OF THE INVENTION

The present invention is directed to an article of apparel, in particular, with an article of apparel with comfort regulation properties.

BACKGROUND OF THE INVENTION

Athletes generate heat as a result of physical activity—skin and/or core body temperature rise during sustained physical exertion. Failure to properly move heat away from the body during exercise may lead to "overheating," i.e., a rise in the core body temperature, potentially resulting in adverse health consequences, such as heat exhaustion or heat stroke. Accordingly, performance apparel may be configured to aid in the regulation of body temperature, with its aim being to keep the wearer cool. One approach configures a garment such that it draws moisture away from the skin. Other approaches equip the garment with tubes through which a cooling fluid flows, while still others provide the garment with pockets that receive cooling packs of various materials. These conventional approaches, however, suffer from disadvantages. Absorbent material, while increasing the comfort of the wearer, does not facilitate absorbing of heat. Cooling tubes and packs, while effective cooling mechanisms, add significant weight to the garment.

Thus, it would be desirable to provide a lightweight article of apparel effective to cool and/or temper the increase in temperature of the user.

BRIEF SUMMARY OF THE INVENTION

The present invention is directed toward an article of apparel including a base textile with a comfort regulation membrane. The comfort regulation membrane contains a plurality of system-reactive components selectively engaged heat and/or moisture. In an embodiment, the printed coating includes a cooling agent, a phase change material, and a heat dissipation material. The system reactive components may be provided in particulate form, being suspended in a binder. In operation, the article of apparel is effective to delay/diminish the rise in skin temperature (compared to a garment lacking the membrane) and/or improve the overall moisture management capacity of the substrate, either of which may improve wearer comfort.

BRIEF DESCRIPTION OF THE SEVERAL VIEWS OF THE DRAWINGS

Like reference numerals have been used to identify like elements throughout this disclosure

DETAILED DESCRIPTION OF THE INVENTION

Figure 1:
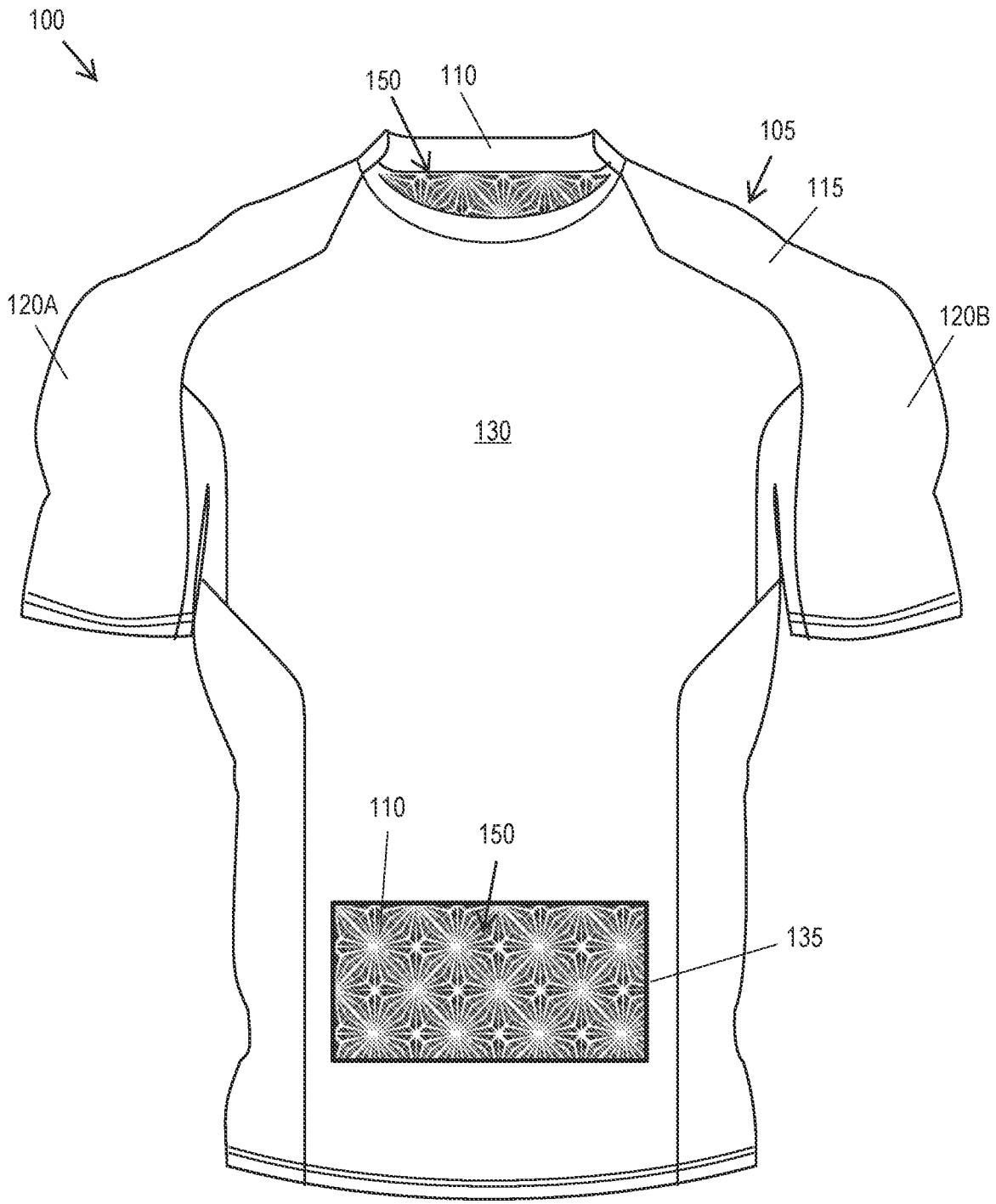
FIG. 1 illustrates a front view in elevation of an article of apparel including a thermal regulation membrane in accordance with an embodiment of the invention.

Referring to FIG. 1, an article of apparel 100 includes a base textile or substrate 105 with an inner surface 110 that faces (contacts) the wearer and an outer surface 115 that faces away from the wearer. The substrate 105 is a fabric (e.g., a woven, knitted, or non-woven fabric) including natural and/or synthetic yarns. By way of example, the yarns may be formed of nylon, polyester, rayon, cotton, elastane, wool, silk, or a blend thereof. The substrate 105 can be treated with dyes, colorants, pigments, UV absorbers, plasticizers, lubricants, flame inhibitors, rheology agents, etc., either before or thereafter application of the thermal regulation membrane.

The substrate 105 may be constructed to have one or more desired properties such as air permeability, absorbance, moisture vapor transmission, and/or capillary action (to draw sweat away from the wearer), abrasion resistance, anti-static properties, anti-microbial activity, water repellence, flame repellence, hydrophilicity, hydrophobicity, wind resistance, UV protection, resiliency, stain resistance, wrinkle resistance, etc. In a preferred embodiment, the substrate is breathable, possessing an air permeability of at least 50 cfm, preferably greater than 70 cfm. By way of example, the substrate may possess an air permeability of about 75 cfm-about 205 cfm.

The substrate 105 forms at least a portion of the article of apparel 100. The article of apparel includes, but is not limited to, athletic wear such as compression garments, shirts, shorts, pants, headwear (e.g., headbands), outerwear (e.g., jackets, hats, gloves), footwear (e.g., shoes, boots, slippers), sleepwear, and undergarments. In the embodiment of FIG. 1, the article of apparel is a compression shirt including arms 120A, 120B and a torso 130. In the figure, the shirt is provided with a cut-away section 135 to reveal the apparel inner surface 110.

A comfort or thermal regulation membrane or layer 150 is disposed on the inner substrate surface 115. The thermal regulation membrane 150 is effective to alter the temperature regulation and/or moisture management properties of the substrate 105. Accordingly, the thermal regulation membrane 150 contains one or more system reactive components. By system reactive, it is intended to mean a compound that reacts to environmental conditions within a system. That is, the system reactive materials are selectively engaged in response to conditions of a wearer wearing the article of apparel. In particular, the compound absorbs, directs, and/or mitigates fluid (heat or water) depending on existing system conditions. For example, a component may initiate an endothermic reaction (e.g., when exposed to water). By way of further example, a component may be capable of selectively absorbing and releasing thermal energy (heat). By way of still further example, a component may be capable or conducting and/or directing heat from one location to another location within a system.

In an embodiment, the system reactive components include a cooling agent, a latent heat agent, and/or a heat dissipation agent. The cooling agent is an endothermic cooling agent, i.e., it creates a system that absorbs heat. Specifically, the cooling agent generates an endothermic reaction in aqueous solution, absorbing energy from its surroundings. Accordingly, the cooling agent possesses a negative heat of solution when dissolved in water. By way of example, the endothermic cooling agent possesses a heat of enthalpy in the range −10 cal/g to −50 cal/g. In particular, the endothermic cooling agent possesses a heat of enthalpy in the range −20 cal/g to −40 cal/g. With this configuration, when the cooling agent is contacted by water (i.e., the sweat of the wearer), the cooling agent is capable of cooling (i.e., lowering the temperature of) the water.

The cooling agent may be a polyol. By way of example, the cooling agent includes one or more of erythritol, lactitol, maltitol, mannitol, sorbitol, and xylitol. In an embodiment, the cooling agent is selected from one or more of sorbitol, xylitol and erythritol. Sorbitol is a hexavalent sugar alcohol and is derived from the catalytic reduction of glucose. Xylitol is produced by catalytic hydrogenation of the pentahydric alcohol xylose. Erythritol is produced from glucose by fermentation with yeast. Crystalline xylitol is preferred. The cooling agent may be present in an amount of about 15 wt % to about 35 wt % (e.g., about 25 wt %).

The latent heat agent is capable of absorbing and releasing thermal energy from a system while maintaining a generally constant temperature. In an embodiment, the latent heat agent is a phase change material (PCM). Phase change materials possess the ability to change state (solid, liquid, or vapor) within a specified temperature range. PCMs absorb heat energy from the environment when exposed to a temperature beyond a threshold value, and release heat to the environment once the temperature falls below the threshold value. For example, when the PCM is a solid-liquid PCM, the material begins as a solid. As the temperature rises, the PCM absorbs heat, storing this energy and becoming liquefied. Conversely, when temperature falls, the PCM releases the stored heat energy and crystallizes or solidifies. The overall temperature of the PCM during the storage and release of heat remains generally constant.

The phase change material should possess good thermal conductivity (enabling it to store or release heat in a short amount of time), a high storage density (enabling it to store a sufficient amount of heat), and the ability to oscillate between solid-liquid phases for a predetermined amount of time. Additionally, the phase change material should melt and solidify at a narrow temperature range to ensure rapid thermal response.

Linear chain hydrocarbons are suitable for use as the phase change materials. Linear chain hydrocarbons having a melting point and crystallization point falling within approximately 10° C. to 40° C. (e.g., 15° C. to 35° C.) and a latent heat of approximately 175 to 250 J/g (e.g., 185 to 240 J/g) may be utilized. In particular, a paraffin linear chain hydrocarbon having 15-20 carbon atoms may be utilized. The melting and crystallization temperatures of paraffin linear chain hydrocarbons having 15-20 carbon atoms fall in the range from 10° C. to 37° C. and 12° C.-30° C., respectively. The phase transition temperature of linear chain hydrocarbons, moreover, is dependent on the number of carbon atoms in the chain. By selecting a chain with a specified number of carbon atoms, a material can be selected such that its phase transition temperature liquefies and solidifies within a specified temperature window. For example, the phase change material may be selected to change phase at a temperature near (e.g., 1° C.-5° C. above or below) the average skin temperature of a user (i.e., a human wearer of the apparel, e.g., 33° C.-34° C.). With this configuration, the phase change material begins to regulate temperature either upon placement of the apparel on the wearer or shortly after the wearer begins physical activity.

In an embodiment, the paraffin is encapsulated in a polymer shell. Encapsulation prevents leakage of the phase change material in its liquid phase, as well as protects the material during processing (e.g., application to the substrate) and during consumer use. The resulting microcapsules may possess a diameter of about 1 to about 500 μm. In an embodiment, the paraffin PCM is present in an amount of about 25 wt % to about 45 wt % (e.g., about 35 wt %).

The heat dissipation agent is effective to conduct heat and/or direct heat from one location to another location within the system (e.g., within the membrane 150 and/or substrate 105). In an embodiment, the heat dissipation agent possesses a high heat capacity, which determines how much the temperature of the agent will rise relative to the amount of heat applied. By way of example, the heat dissipation agent is a silicate mineral such as jade, e.g., nephrite, jadeite, or combinations thereof. The heat dissipation material may be present in an amount (dry formulation) of about 30 wt % to about 50 wt % (e.g., about 40 wt %).

The system reactive components are present with respect to each other in a ratio of approximately 1:1 to 1:2. By way of example, the ratio of temperature reactive components—cooling agent, latent heat agent, and heat dissipation agent—may be approximately 1:2:2, respectively. As indicated above, in system reactive component mixture, the cooling agent is present in an amount of from 15 wt % to 35 wt %; the latent heat agent is present in an amount of from 25 wt % to 45 wt %. Similarly, the heat dissipation agent is present in an amount of from 25 wt % to 45 wt %.

In addition to the temperature reactive components, the thermal regulation membrane 150 further includes a binder effective to disperse the temperature reactive components and/or to adhere the temperature reactive components to the substrate 105 (e.g., to the yarns/fibers forming the substrate). The binder may be an elastomeric material possessing good elongation and tensile strength properties. Elastomeric materials typically have chains with high flexibility and low intermolecular interactions and either physical or chemical crosslinks to prevent flow of chains past one another when a material is stressed. In an embodiment, polyurethane (e.g., thermoplastic polyurethane such as polyester-based polyurethane) is utilized as the binder. In other embodiments, block copolymers with hard and soft segments may be utilized. For example, styrenic block copolymers such as a styrene-ethylene/butylene-styrene (SEBS) block copolymer may be utilized.

Figure 2:
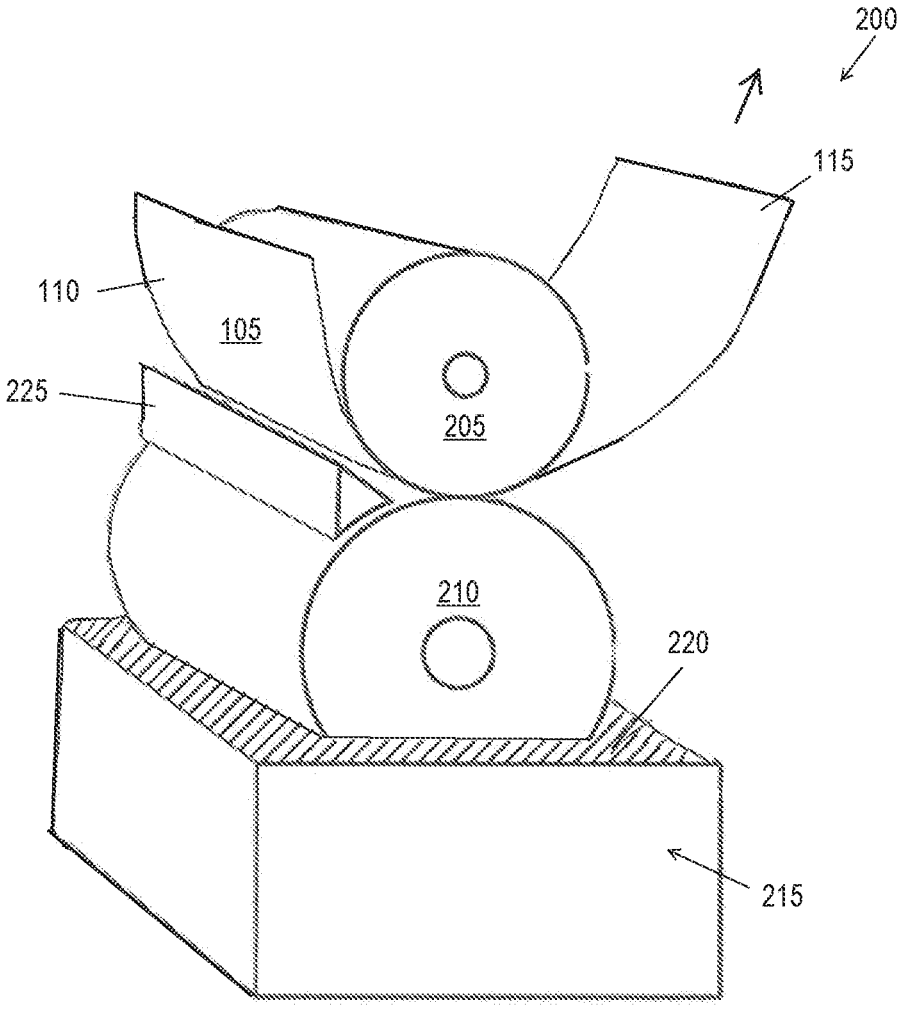
FIG. 2 illustrates a schematic of an apparatus for applying the thermal regulation membrane to the substrate.

The comfort regulation membrane 150 is applied to the substrate 105 in a manner that maintains the integrity of the components and preserves properties of the substrate. In an embodiment, the thermal regulation membrane is applied as a composition transferred to the substrate via printing process. By way of example, the composition is transferred via a rotogravure apparatus 200. Referring to FIG. 2, the rotogravure apparatus 200 includes an impression roller 205, a gravure or etched cylinder 210, and a tank 215. The cylinder 210 is engraved/etched with recessed surface cells in a desired pattern (pattern not illustrated in FIG. 2). The tank 215 holds the thermal regulation composition 220. The apparatus 200 further includes a doctor blade 225 operable to remove excess composition from the cylinder 210.

In an embodiment, the comfort regulation composition 220 includes about 20 wt % system reactive components (the cooling agent, the latent heat agent, and the phase change material), 30 wt % binder, and about 50 wt % solvent (aqueous or non-aqueous (e.g., methyl ethyl ketone)). In other embodiments, the thermal regulation composition may further include pigments or other additives such as surfactants.

In operation, as the cylinder 210 rotates, a portion of the cylinder becomes immersed in the thermal regulation composition 220 stored in the tank 215. The composition 220 coats the cylinder 210, becoming captured within the cells. The cylinder continues to rotate, moving the coated cylinder past the doctor blade 225, which removes excess composition 220 from the cylinder 210. The substrate 105 is directed between the impression roller 205 and the cylinder 210 such that the inner surface 110 of the substrate (e.g., what will be the wearer-facing side of the apparel) contacts the cylinder 210. Specifically, the impression roller 205 applies force to the substrate 105, pressing the substrate onto the cylinder 210, thereby ensuring even and maximum coverage of the thermal regulation composition 220. Surface tension forces pull the composition 220 out of the cells, transferring it to the substrate 105. Accordingly, the rotogravure apparatus 200 applies an initial or first pressure to the substrate 105 at an initial or first temperature (e.g., ambient temperature) to transfer the thermal regulation composition 220 to the substrate surface 115. Once the composition 220 is transferred, the coated substrate may pass through one or more heaters to evaporate the solvent, thereby drying the composition and forming the dry membrane layer 150. If a thicker membrane is desired, additional passes through the rotogravure apparatus 200 may be completed.

Figure 3:
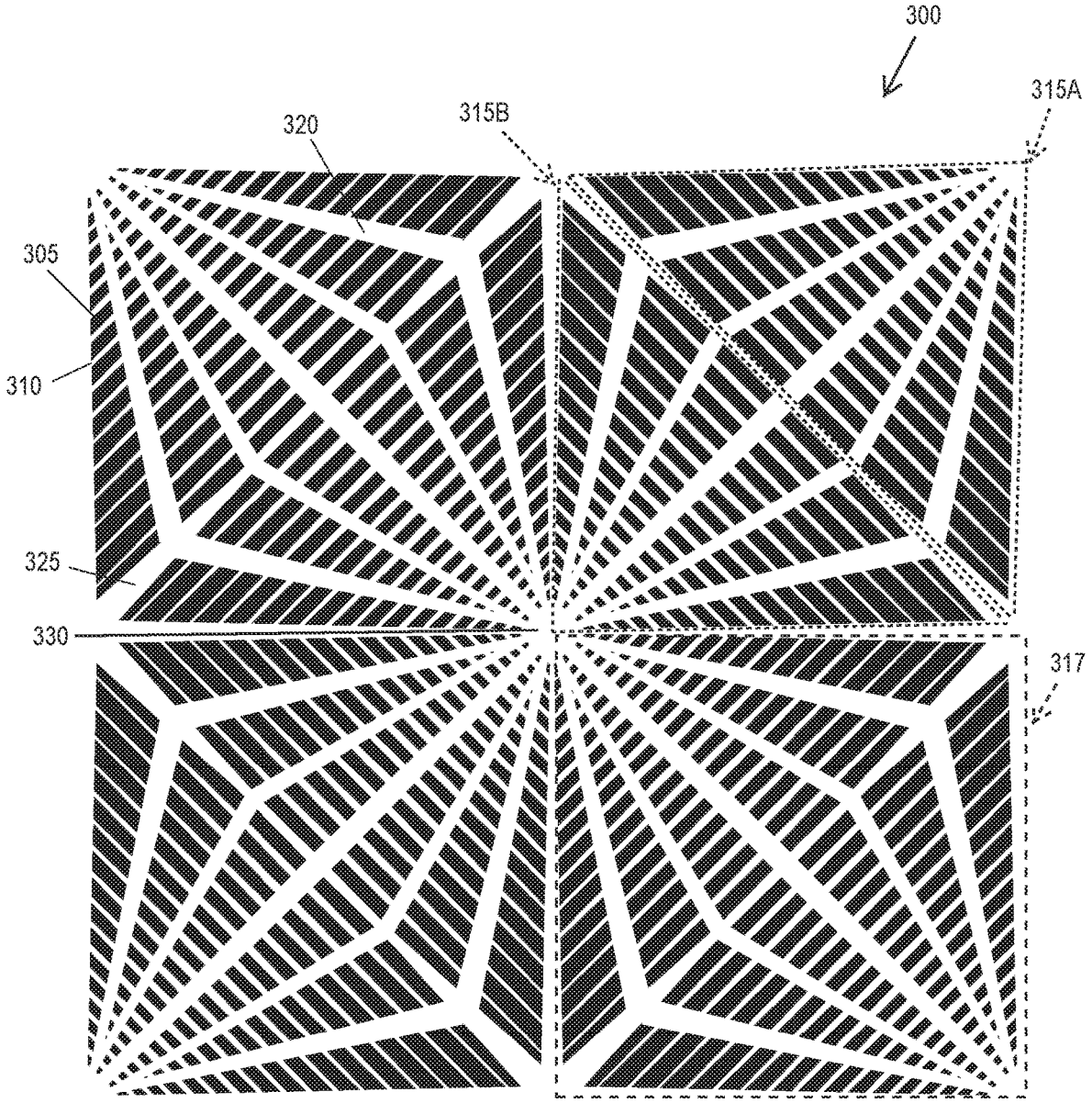
FIG. 3 illustrates an application pattern of the thermal regulation membrane in accordance with an embodiment of the invention.

The thermal regulation composition 220 may be applied to the substrate 105 in any pattern suitable for its described purpose. In an embodiment, the thermal regulation membrane 150 is applied in a repeating pattern of units. Referring to FIG. 3, each unit 300 includes generally linear elements 305 oriented in spaced relationship from each other, being separated by element channels 310 such that adjacent elements are oriented generally parallel to each other. The dimensions of each linear member 305 and channel 310 may be any suitable for its described purpose.

The linear members 305 are organized such that a discontinuous array of elements spans the substrate surface 110. In the illustrated embodiment, the linear members 305 are organized such that they cooperate to define a first or outer triangular section 315A and a second or inner triangular section 315B. The first triangular section 315A is a minor image of the second triangular section 315B, and vice versa. The triangle sections 315A, 315B, in turn, cooperate to define a quadrant or substructure 317 of the unit 300. Each quadrant 317 is intersected by one or more (e.g., five) radial channels 320, as well as a segment channel 325 that separates the first triangle section 315A from the second triangle section 315B. The radial 320 and segment 325 channels may possess a wider transverse dimension than the element channels 310. The substructures 310, moreover, cooperate to define a central aperture 330 disposed the center of the structure 300.

Figure 4:
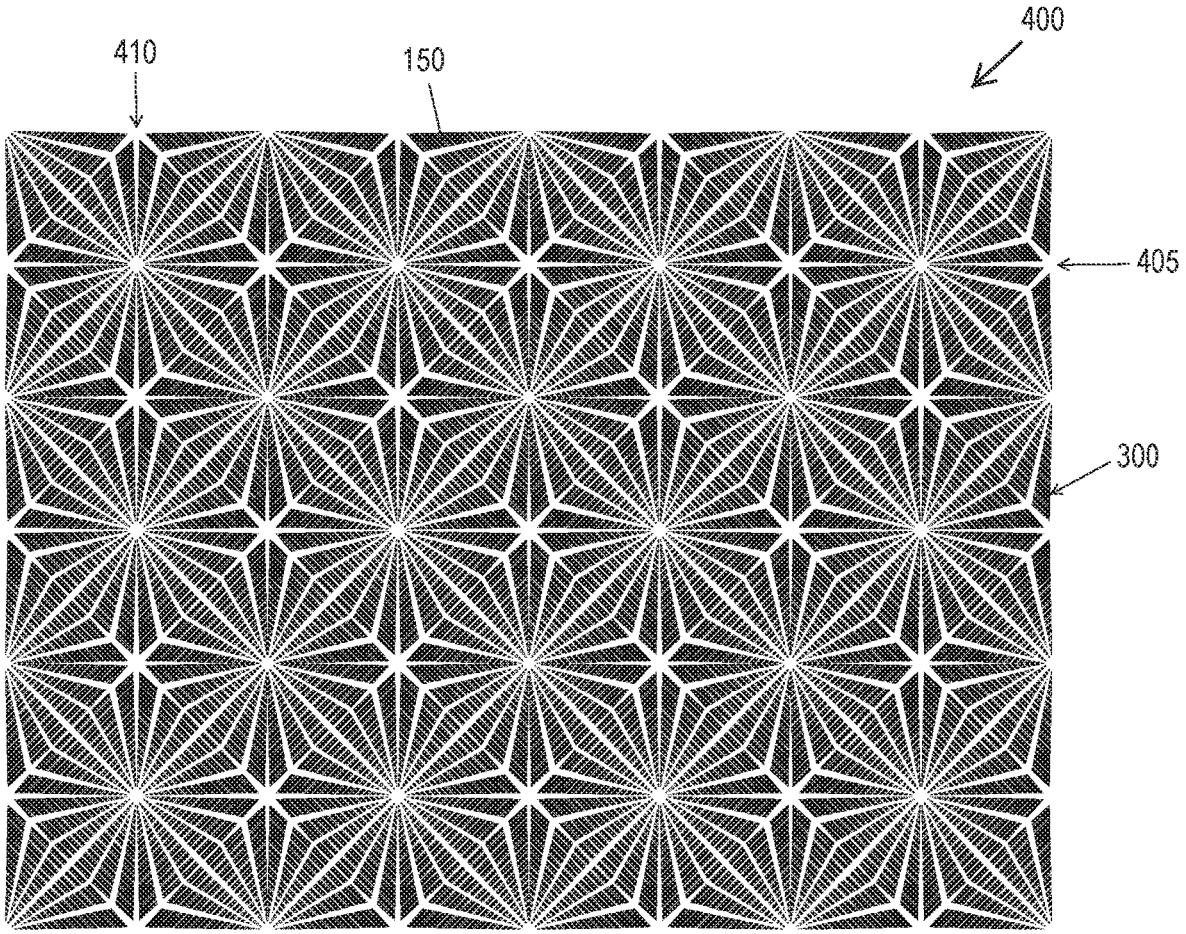
FIG. 4 illustrates the application pattern of FIG. 3, shown in an array.

Referring to FIG. 4, a plurality of units 300 are disposed adjacent each other form a pattern 400 on the substrate. Specifically, the units 300 are oriented in rows 405 and columns 410 along the substrate 110 such that a network of interconnecting channels is formed. With this configuration, the linear members 305 represent areas along the substrate including (covered by) the thermal regulation membrane 150. The channels 310, 320, 325 and apertures 330 in contrast, define areas free (e.g., substantially free) of the thermal regulation membrane 150. The areas covered by the thermal regulation membrane 150 modify the properties of the substrate 105 by providing increased (improved) temperature regulation properties to the substrate (compared to an area free of membrane). The substrate properties in the areas free of the thermal regulation membrane, in contrast, are not modified. This creates a bimodal surface in which the properties of the substrate 105 (e.g., air permeability, vapor transmission, etc.) and the properties of the membrane 150 cooperate to provide the article of apparel 100 with desired properties (explained in greater detail below). Stated another way, the each unit 300 of the pattern 400 may include a ratio of free area to treated area falling within predetermined values. By way of example, the ratio of free area to covered area may be approximately 3:1 (i.e., the treated area covers approximately 30% of the substrate surface 115).

After drying, the coated substrate 105 is processed to further integrate the membrane 150 into the fibers/yarns of the substrate. In an embodiment, the coated substrate 150 is subjected to a second pressure and temperature different from the temperature and pressure applied during the rotogravure process. In particular, the coated substrate 150 is subjected to a calendaring process in which the coated substrate is passed between a pair of heated rollers. The temperature of the rollers (and thus the temperature applied to a substrate surface (coated or non-coated)) may range from about 25° C. to about 55° C. Temperatures above this range cause puckering in the fabric (e.g., along the patterned areas). Temperatures below this range are generally insufficient to improve the hand of the fabric. In a preferred embodiment, the substrate 105 (e.g., the coated surface 115) is calendared at a temperature of approximately 30° C. The pressure applied to the substrate by the rollers ranges from about 30-70 lbs, with about 50 lbs being preferred. Pressures above this range risk rupturing the PCM material, while pressures below this range are insufficient to press the membrane into fabric cavities. The speed at which the fabric passes through the calendaring apparatus may be in the range of about 300-400 rpm, with about 350 rpm being preferred.

Figure 5A:
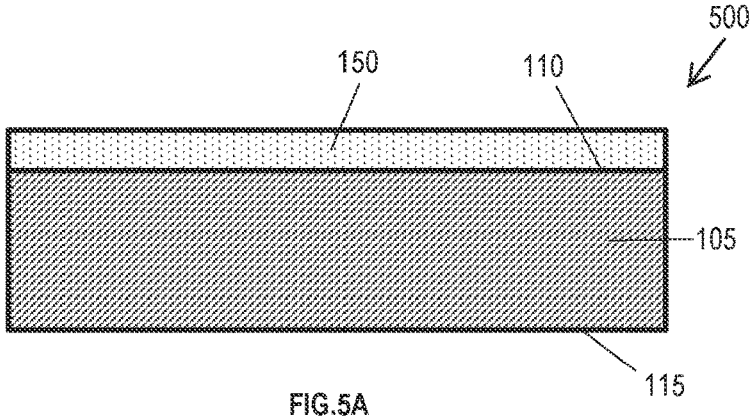
FIGS. 5A, 5B, and 5C illustrate the process wherein an apparatus applies heat and pressure to a coated substrate to integrate the thermal regulation apparel with the substrate.
Figure 5B:
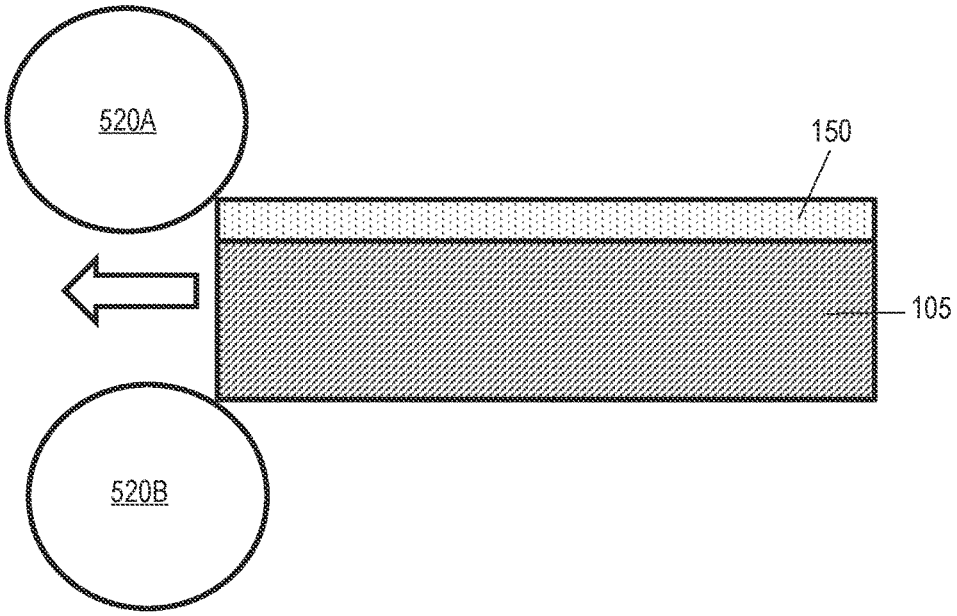
Figure 5C:
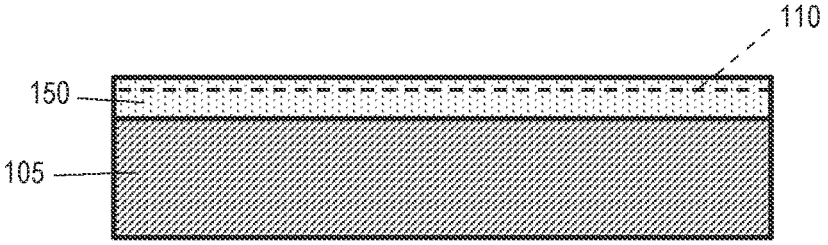

The above calendaring process not only improves the hand of the coated substrate, but also integrates the thermal regulation membrane 150 into the substrate 105. Referring to FIGS. 5A, 5B, and 5C, a coated substrate 500 includes the substrate 105 with the thermal regulation membrane 150 disposed on inner substrate surface 110 (while shown to be a continuous layer, it should be understood that the thermal regulation membrane may be discontinuous). The coated substrate 500 is drawn through the calendaring rollers 520A, 520B (FIG. 5B). As explained above, the rollers 520A, 520B apply heat and pressure to the substrate 105 and membrane 150, urging at least a portion of the membrane below the substrate surface 110. It is believed that the membrane binder softens, permitting the membrane 150 to enter into the openings between the fibers and/or coat the fibers of the substrate 105. Alternatively, the heat and pressure may soften the substrate fibers, increasing the relative movement of the fibers, thereby creating openings in the textile that receive the membrane 150. Regardless, calendaring may result in yarns/fibers intersecting (e.g., protruding from) the membrane 150 and/or may result in the membrane coating/enveloping individual fibers along (e.g., below) the interface 110. As shown (FIG. 5C), after calendaring, the membrane 150 is pressed into the substrate 105 (beyond initial substrate surface 515), becoming integrated therewith.

By way of further explanation, it is believed that composition and processing result in a porous or semi-porous membrane including pores or pockets formed therein. That is, the high ratio of system reactive component particles to binder—as well as the compression of the membrane 150 into the substrate 105—may create fissure, pores, or cavities within the membrane. These pores/cavities may be effective to transporting water within the system. Specifically, the membrane 150 may transport water away from the skin of the wearer and into the pores/cavities, where one or more of the system reactive components are located. Thus, when fluid is drawn toward the cooling agent, the agent may absorb water to generate the endothermic reaction. Alternatively, the water may become trapped in a cavity within the membrane, or pass completely through the membrane to the substrate 105. Accordingly, in addition to tempering the temperature within the system, the membrane 150 further improves the overall moisture management capacity of the substrate 105 compared to an untreated substrate (discussed in greater detail below).

The process of forming the article of apparel is explained with reference to FIG. 6. The process 600 begins at Step 605, with the substrate 105 being obtained. As explained above, the substrate 105 may be woven, non-woven, or knitted, and may possess predetermined properties falling within specified ranges (air permeability, fluid movement, etc.). By way of example, the substrate 105 is a four-way stretch fabric including polyester and elastane fibers. In Step 610, the thermal regulation coating is obtained. By way of example, approximately 25 wt % crystalline xylitol, approximately 40 wt % jade particles, and approximately 35 wt % encapsulated paraffin is mixed to form a system reactive component mixture (dry mixture). The system reactive component mixture is combined with solvent (methyl ethyl ketone) and binder (polyurethane) to form the thermal regulation composition 220. The resulting composition includes approximately 20 wt % system reactive agent (approximate 5 wt % xylitol, 8 wt %, jade, 7 wt % PCM in solution), approximately 30 wt % binder, with the remainder solvent (approximately 50 wt %).

In Step 615, the thermal regulation composition 220 is applied to the surface 110 (the wearer-facing surface) of the substrate 105 at a first temperature and pressure in the manner explained above (via rotogravure). Once applied, at Step 620, the coating is dried (e.g., via heating), thereby forming the thermal regulation membrane 150. In step 625, the substrate 105 is processed at a second temperature and pressure. In particular, the coated substrate is calendared as explained above (roller temperature 30° C. at 50 lbs pressure and roll speed of 350 rpm). Finally, the coated and calendared substrate 105 may be integrated into an article of apparel in Step 630. By way of example, the substrate may be treated like conventional fabric, being cut and sewn to form a desired garment.

Figure 7A:
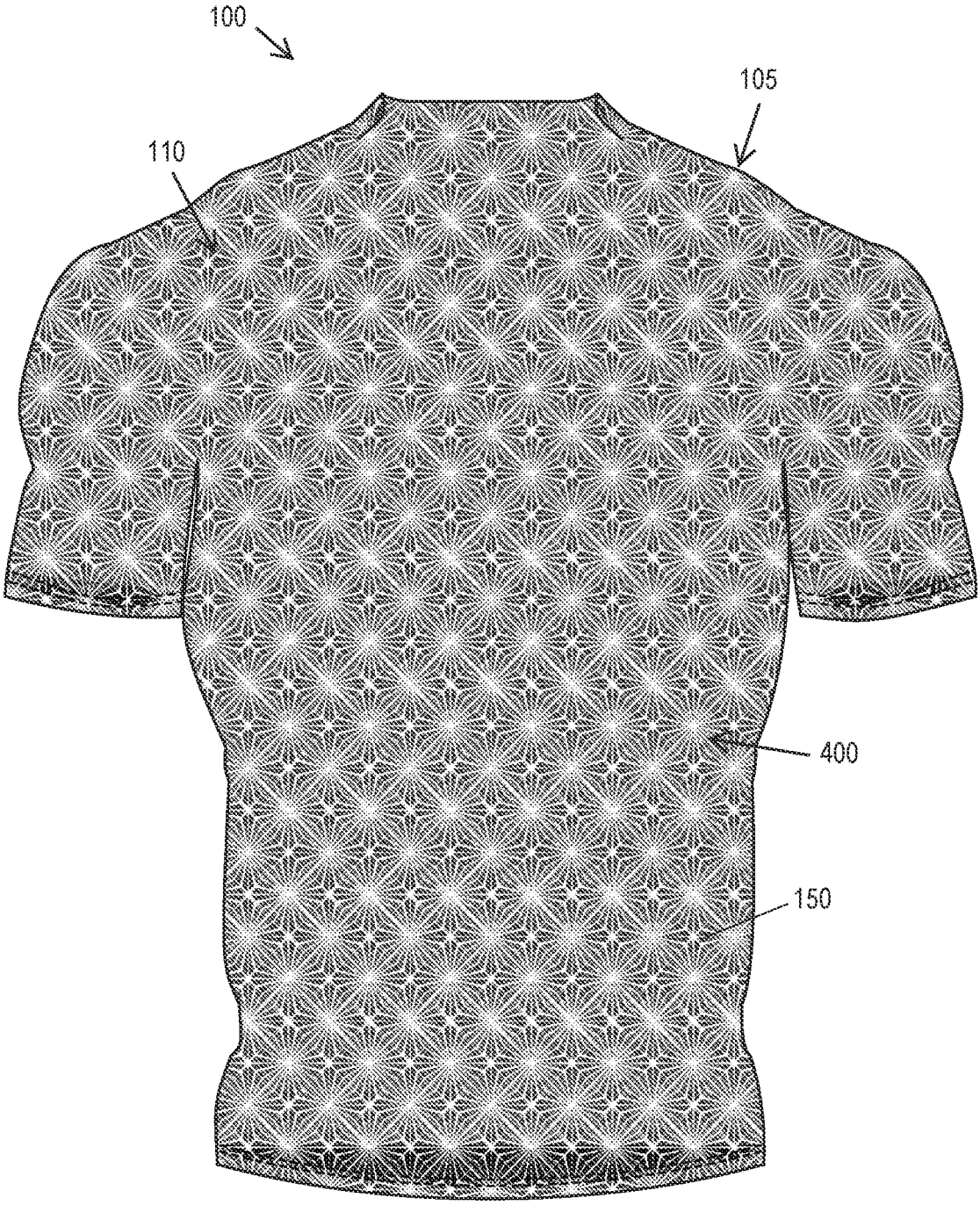
FIGS. 7A and 7B illustrate the application pattern of FIG. 4 applied to the interior surface of an article of apparel, with the patterns shown in a smaller (FIG. 7A) and larger (FIG. 7B) scale.
Figure 7B:
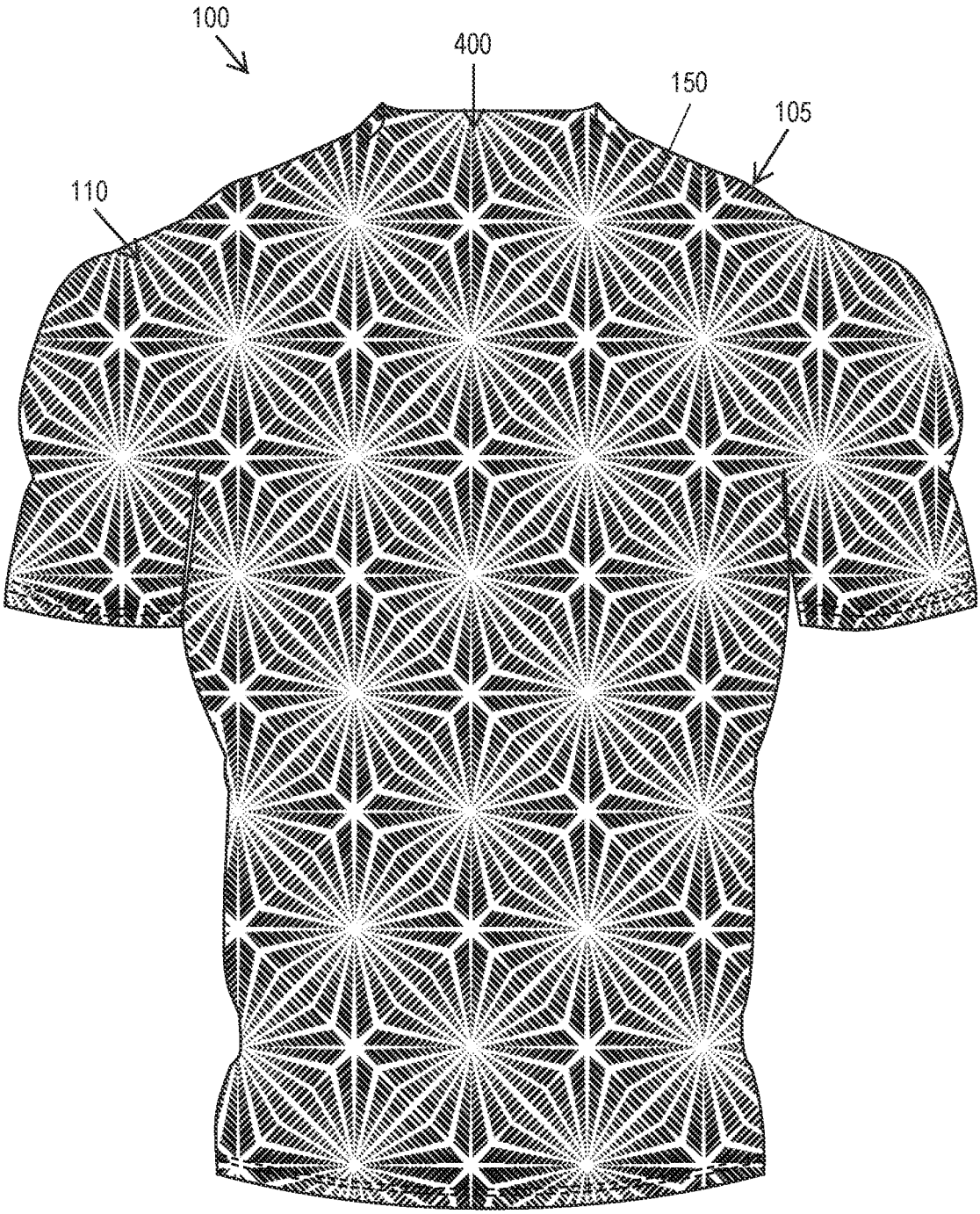

Referring to FIG. 7, the substrate 105 may form a compression shirt. The pattern 400 may be modified to provide the desired level of coverage. For example, the scale and/or density of the pattern may be modified. For example, the embodiment of FIG. 7A possesses a high density pattern, which covers more surface area of the substrate than the low density pattern of FIG. 7B. As explained above, the desired level of coverage is up to about 30% of the surface area of the substrate 105. That it, when the thermal regulation member 150 is applied to the substrate 105, the surface area of the substrate surface 115 covered by the membrane is approximately 30% or less.

The resulting thermal regulation membrane 150 is effective to improve the thermal comfort of a wearer. In particular, the thermal regulation membrane is effective to either delay the increase of skin temperature and/or maintain the skin temperature at a lower value compared to the same substrate lacking the thermal regulation membrane.

EXPERIMENTAL I

Fourteen test subjects (male and female, ages 21-26, BMI 21-26) completed two trials, each including 45 minutes of interval running in an environmental chamber set to 35.5° C. and 54.5% relative humidity (heat index=43.2° C.). The environment was selected to provide an environment in which sweating (evaporative cooling) was the only cooling mechanism occurring (i.e., no radiation, no convection, and no conduction). The subjects were allowed unlimited water intake during their experimental exercise sessions in order to maintain hydration. Environmental temperature and relative humidity were measured using a digital meter, while heat index was calculated using a standard equation. There were no significant differences among the conditions or over time. Accordingly, it was determined that a similar quantity of heat stress was applied during each shirt condition.

The exercise protocol included intervals of different exercise stimuli designed to elicit specific quantities of heat gain. Specifically, the test subjects ran on a treadmill that, at intervals, was either set to a low speed (3.5 mph) or a high speed (5 mph). Seven intervals were utilized, ranging from five minutes to 10 minutes. In the first trial, the test subjects wore a compression shirt having the thermal regulation membrane 150 described above in reference to the process flow diagram (FIG. 6). In the second trial, test subjects work a compression shirt free of the thermal regulation membrane 150. Thus, tests were run on the same substrate, one provided with the membrane 150 (trial 1) and one unprinted (trial 2). Skin temperature was measured via sensors and wireless data loggers set to record at regular intervals. Measurements were taken along the front of the neck, underneath the article of apparel 100 (a short-sleeved compression shirt).

The skin temperature measurements taken at five-minute intervals (from time=5 min to time=45 min, with temperatures of all users averaged) were lower for the test subjects wearing the treated article of apparel (trial 1) than for the test subjects wearing the untreated article of apparel (trial 2) (skin temperature measurements taken at the same time interval, i.e., at the same point during the same physical activity). In other words, the thermal regulation membrane 150 was effective to lessen the increase of wearer skin temperature during physical activity. The membrane tempered/modulated the increase. Thus, a user wearing the treated shirt for a predetermined period of time would experience lower skin temperatures for a predetermined period of time after commencement of activity. Reduced skin temperature is critical factor in user comfort (along with airflow, and vapor transfer).

While not being bound to theory, it is believed that the system reactive components become active in stages, reacting to the environment (the interface between the article of apparel 100 and the skin of the wearer). In particular, it is believed the heat dissipation agent is active immediately upon placement onto a user. That is, heat generated by the wearer (and escaping from wearer's skin) is conducted by the jade and directed outward, through the substrate 105 to the ambient environment. When wearer temperature increases beyond the steady state of the heat dissipation agent (such that the heat dissipation agent can no longer exhaust all the heat energy produced by the wearer), and when the temperature of the environment increases beyond the fusion temperature of the phase change material, the latent heat agent becomes active, absorbing heat energy and storing it while maintaining a generally consistent temperature.

Additionally, when the temperature of the wearer increases, the body's evaporative cooling response will activate, causing the body to sweat. Once exuded, the perspiration (water) will either contact a treated or untreated area of the substrate 105. In untreated areas (i.e., areas free of membrane 150), the perspiration will be pulled outward, away from the skin via capillary action. In treated areas (i.e., areas coated with the thermal regulation membrane 150), the perspiration will contact the endothermic cooling agent, generating an endothermic reaction and lowering the temperature of the water.

Additionally, as the skin temperature decreases, the latent heat agent (the phase change material) will reach its crystallization temperature, releasing the heat previously stored. The heat dissipation agent remains active, conducting the heat released by the latent heat agent and directing it outward (away from the wearer), through the substrate 105 and into the surrounding environment.

Accordingly, the article of apparel is effective to dissipate heat not only during heat-up (when the wearer's temperature is rising), but also during cool down (when the wearer's temperature is lowering).

EXPERIMENTAL II

Figure 6:
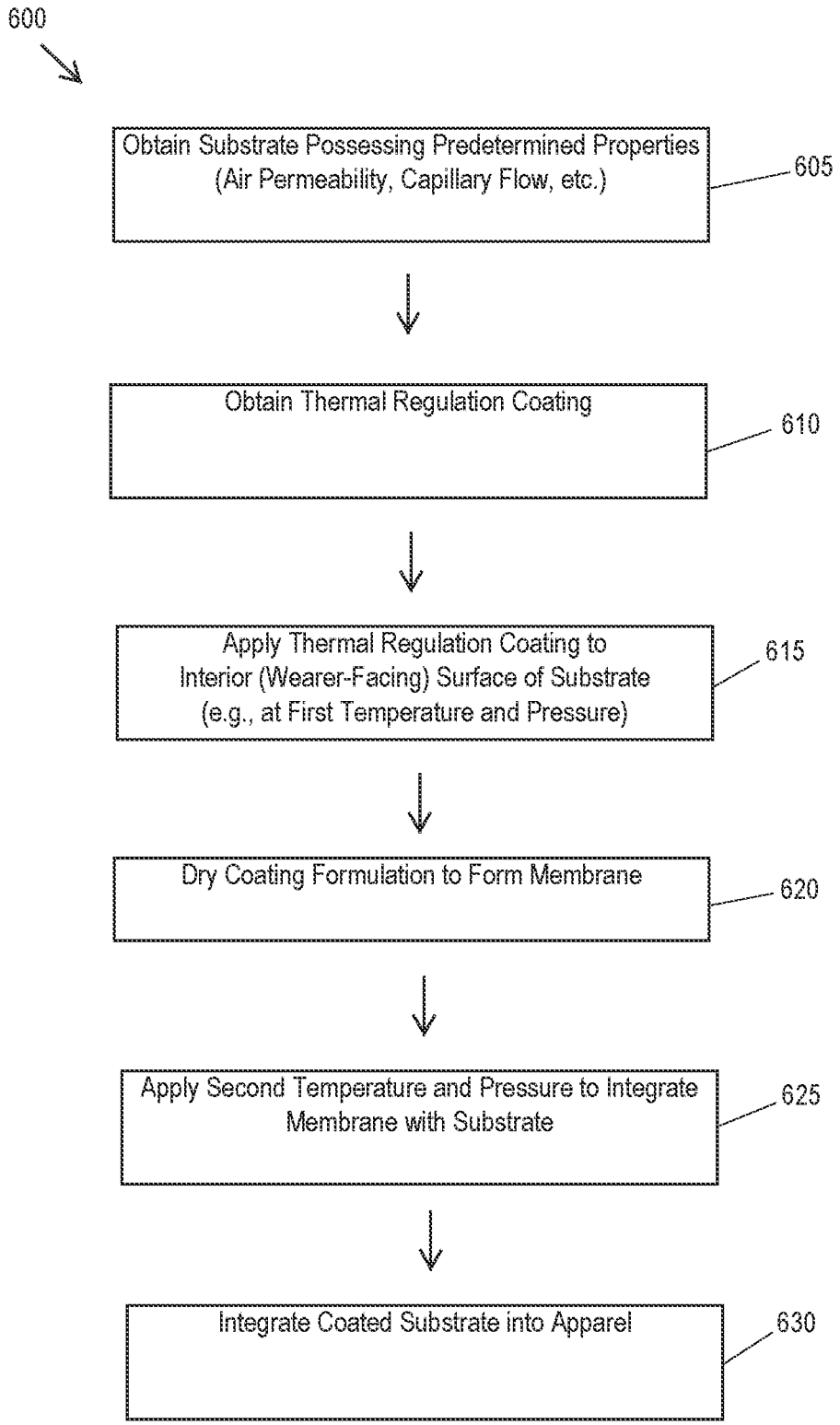
FIG. 6 illustrates a flow diagram of the process of forming the article of apparel.

A substrate material including a knitted fabric of elastane and polyester was treated thermal regulation membrane 150 described above in reference to the process flow diagram (FIG. 6). Additionally, a second, untreated substrate was obtained. Moisture management properties of the substrates were measured utilizing a moisture management tester and known protocols (e.g., AATCC™ 195), including back and face wetting time (second), back and face absorption rate (%/second), back and face wetted radius (millimeter), back and face spreading speed (millimeter/second), cumulative one way transport capacity, and overall moisture management capacity (OMMC). The results are provided in Table I.

TABLE I

| Measurement (Measured at Back or Face of Substrate) units | Wetting Time-Back s | Wetting Time-Face s | Absorption Rate-Back %/s | Absorption Rate-Face %/s | Max Wetted Radius-Back mm | Max Wetted Radius-Face mm | Spreading Speed-Back mm/sec | Spreading Face mm/sec | One-Way Transport Index % | OMMC |
|---|---|---|---|---|---|---|---|---|---|---|
| Treated Substrate | 5.80 | 5.74 | 54.1 | 64.2 | 20.8 | 25.8 | 3.06 | 3.36 | 145.02 | 0.5387 |
| Untreated Substrate | 3.56 | 3.53 | 54.5 | 53.9 | 20.0 | 20.0 | 3.28 | 3.34 | 15.72 | 0.3904 |

As shown, the overall moisture management capacity of the treated substrate is significantly higher (closer to 1.0) than that of the untreated substrate. Moisture management property is a key factor in determining the comfort of the wearer—the wearer's perception of moisture is affected by the transmittance of moisture through the substrate. Thus, controlling the movement of moisture from the skin and to the atmosphere via the fabric is critical in improving user comfort. Here, the treated substrate possesses an improved overall moisture management capacity relative to the untreated substrate. While not being bound to a particular theory, it is believed the thermal regulation membrane 150 may include cavities or pores as a result of the particulate material and/or the softening/compression processing as explained above. Accordingly, water from the wearer's skin is drawn into the membrane 150, passing through the substrate 105, becoming captured in a cavity, and/or interacting with a system reactive agent.

While the invention has been described in detail and with reference to specific embodiments thereof, it will be apparent to one skilled in the art that various changes and modifications can be made therein without departing from the spirit and scope thereof. For example, the thermal regulation membrane 150 may be applied in a pattern or a continuous or discontinuous array. A discontinuous pattern has been found to provide cooling to the user while still allowing the base fabric to perform desired properties (e.g., breathe and allow moisture vapor to escape through the fabric in order to reduce the level of moisture build up). While linear elements are illustrated, other shapes are possible including circles, triangles, squares, pentagons, hexagons, octagons, stars, crosses, crescents, and/or ovals.

In an embodiment, the units 300 of the thermoregulation membrane 150 may be arranged such that they are in connection with one another, such as a lattice pattern or any other pattern that permits partial coverage of the substrate. For example, the composition may be disposed on the substrate 105 in a pattern with discontinuous elements and/or interconnected geometrical patterns. In various embodiments, the pattern 400 may be symmetrical, ordered, random, and/or asymmetrical. Moreover, the pattern 400 of thermal regulation membrane 150 may be disposed on the substrate 105 at strategic locations to improve the performance of the article of apparel 100. In various embodiments, the size and/or spacing of the linear members 305 or units 300 may also be varied in different areas of the article of apparel to balance the need for enhanced cooling properties and preserve the functionality of the substrate.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

We claim:

1. A method of forming an article of apparel, the method comprising:

obtaining a thermal regulation composition comprising a plurality of system reactive components, wherein the system reactive components comprise a binder, a water-activated cooling agent, a reversible state latent heat agent, and a mineral heat dissipation agent, the water-activated cooling agent is present in an amount from 15 wt % to 35 wt % of the system reactive components, the reversible state latent heat agent is present in an amount from 25 wt % to 45 wt % of the system reactive components, and the mineral heat dissipation agent is present in an amount from 25 wt % to 45 wt % of the system reactive components;

printing the thermal regulation composition to a surface of a textile by pressing the thermal regulation composition against the textile surface such that the binder adheres the water-activated cooling agent, the reversible state latent heat agent, and the mineral heat dissipation agent to the surface of the textile, thereby forming a thermal regulation membrane; and incorporating the textile into an article of apparel.

2. The method of claim 1, wherein the printing further comprises:

pressing the thermal regulation composition into the textile such that a first portion of the thermal regulation membrane is below the surface of the textile substrate while a second portion of the thermal regulation membrane remains above the textile substrate.

3. The method of claim 1, wherein the water-activated cooling agent comprises a polyol.

4. The method of claim 1, wherein the reversible state latent heat agent comprises a paraffin linear chain hydrocarbon having 15-20 carbon atoms.

5. The method of claim 1, wherein the mineral heat dissipation agent comprises a silicate mineral.

6. The method of claim 1, wherein the binder comprises a polyurethane.

7. The method of claim 1, wherein the textile substrate is selected from the group consisting of a woven fabric, a knitted fabric, and a nonwoven fabric.

8. The method of claim 1, wherein the textile is incorporated into the article of apparel such the thermal regulation membrane faces a wearer of the article of apparel.

9. The method of claim 1, wherein the thermal regulation membrane covers up to 30% of the surface area of the surface of the textile.

10. The method of claim 1, wherein:

printing comprises pressing the thermal regulation composition in a discontinuous pattern along the surface of the textile, the discontinuous pattern forming a bimodal textile surface defining treated and untreated areas; and properties of the untreated areas and the properties of the treated areas cooperate to provide the article of apparel with temperature regulation properties.

11. The method of claim 1, further comprising compressing the textile by passing the textile between a pair of rollers heated to a predetermined temperature, the roller pair applying a predetermined pressure to the textile.

12. The method of claim 11, wherein compressing the textile with the thermal regulation membrane occurs at a temperature ranging from 25° C. to 55° C. and at a pressure ranging from 30 lbs to 70 lbs.

13. An article of apparel comprising:

a textile substrate including a first surface and a second surface opposite the first surface; and a thermal regulation membrane formed as a printed coating by pressing a thermal regulation material on the first surface of the textile substrate such that a first portion of the formed thermal regulation membrane is below the first surface of the textile substrate while a second portion of the thermal regulation membrane is exposed above the first surface of the textile substrate, the thermal regulation membrane comprising a plurality of system reactive components, the system reactive components being selectively engaged in response to conditions of a wearer wearing the article of apparel, wherein the plurality of system reactive components comprises a cooling agent present in an amount from 15 wt % to 35 wt % of the system reactive components and comprising a polyol, a latent heat agent present in an amount from 25 wt % to 45 wt % of the system reactive components and comprising a paraffin linear chain hydrocarbon having 15-20 carbon atoms, and a heat dissipation agent present in an amount from 25 wt % to 45 wt % of the system reactive components and comprising a silicate mineral.

14. The article of apparel of claim 13, wherein the silicate mineral comprises jade.

15. The article of apparel of claim 13, wherein the thermal regulation membrane is discontinuous and defines treated areas and untreated areas along the first substrate surface, and the untreated areas comprise a plurality of intersecting channels disposed between and separating sections of treated areas.

* * * * *